US007913509B2

(12) United States Patent
Lee et al.

(10) Patent No.: US 7,913,509 B2
(45) Date of Patent: Mar. 29, 2011

(54) REFRIGERATOR

(75) Inventors: Myung Ryul Lee, Seongnam-si (KR); Seung Hwan Oh, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 294 days.

(21) Appl. No.: 11/989,870

(22) PCT Filed: Feb. 1, 2005

(86) PCT No.: PCT/KR2005/000295

§ 371 (c)(1),
(2), (4) Date: Jan. 6, 2009

(87) PCT Pub. No.: WO2006/083048

PCT Pub. Date: Aug. 10, 2006

(65) Prior Publication Data

US 2009/0193832 A1 Aug. 6, 2009

(51) Int. Cl.
*F25C 5/18* (2006.01)

(52) U.S. Cl. ..... 62/344; 62/353

(58) Field of Classification Search ..... 62/344, 62/353

See application file for complete search history.

(56) References Cited

U.S. PATENT DOCUMENTS 3,211,338 A * 10/1965 Weil et al. ..... 222/643
3,798,923 A * 3/1974 Pink et al. ..... 62/266
3,918,266 A * 11/1975 Gindy et al. ..... 62/137
4,176,528 A * 12/1979 Frohbieter ..... 62/344
5,105,631 A * 4/1992 Watanabe et al. ..... 62/344
5,125,242 A * 6/1992 von Blanquet ..... 62/320
6,167,711 B1 * 1/2001 Slattery et al. ..... 62/78
6,952,935 B2 * 10/2005 Vorosmarti et al. ..... 62/344
7,065,975 B1 * 6/2006 Herndon et al. ..... 62/66
7,266,951 B2 * 9/2007 Anselmino et al. ..... 62/66
7,373,789 B2 * 5/2008 Oh et al. ..... 62/320
2001/0027654 A1 10/2001 Shapiro et al.

FOREIGN PATENT DOCUMENTS

EP 1482263 12/2004
JP 14-031445 1/2002
KR 10-0201406 3/1999

OTHER PUBLICATIONS

Korean Office Action issued in KR Application No. 10-2003-0064842 dated Jul. 29, 2005.

* cited by examiner

*Primary Examiner* — William E Tapolcai
(74) *Attorney, Agent, or Firm* — KED & Associates, LLP

(57) ABSTRACT

The present invention provides a refrigerator, in which cold-storage (1) and freezer rooms (2) are situated at upper and lower parts, respectively, in which ice made at the freezer room (2) of the lower part is dispensed at the cold-storage room (1) of the upper part, and by which a user can pick up the ice without bending over to enhance user's convenience. The present invention includes a body (B) having a cold-storage room (1) provided to an upper part and a freezer room (2) provided to a lower part, an ice maker (400) provided to the freezer room to make ice, an ice bank (600) receiving the ice made by the ice maker, and a transport mechanism sending the ice discharged from the ice bank (600) toward the cold-storage room (1) via an ice transport passage (200*a*, 300). Therefore, the present invention sufficiently secures the spaces of the cold-storage and freezer rooms to raise spatial efficiency.

18 Claims, 3 Drawing Sheets

REFRIGERATOR

TECHNICAL FIELD

The present invention relates to a refrigerator, and more particularly, to an ice pickup apparatus for a refrigerator.

BACKGROUND ART

Generally, a refrigerator is partitioned into a freezer room and a cold-storage room. The cold-storage room stores food and vegetable at a temperature of 3~4° C., whereas the freezer room deep-freezes food such as meat and fish to store at a temperature below zero for a long term.

Various functions such as a vegetable (Kimchi) storage and the like are provided to a refrigerator for user's convenience. An ice-making is one of supplementary functions of the refrigerator, which will be explained in the following.

A refrigerator configuration, in which a cold-storage room is provided to an upper part thereof and in which a freezer room is situated under the cold-storage room, is explained with reference to FIG. 1 as follows.

Referring to FIG. 1, a cold-storage room 1 is provided to an upper part of a refrigerator body and a freezer room 2 is provided under the cold-storage room 1.

Doors are provided to selectively open/close the cold-storage and freezer rooms 1 and 2, respectively. And, an ice machine is provided to the freezer room 2.

The ice machine consists of an icemaker making ice and an ice bank storing the made ice therein.

Since the ice machine is provided within the freezer room situated in a lower part of the refrigerator body, a user opens the freezer room to pick up ice from the ice bank directly.

However, the related art refrigerator has the following problems.

First of all, since the ice bank is provided to the freezer room situated at a lower part of the related art refrigerator having the ice machine provided within the freezer room in the lower part of the refrigerator body, it is inconvenient for a user to bend over to pick up the ice.

Namely, in the related art refrigerator having the ice machine provided within the freezer room in the lower part of the refrigerator body, the ice machine is situated at the freezer room in the lower part of the refrigerator. Hence, to pick up ice, a user needs to bend over to open the freezer room and then pick up the stored ice out of the ice bank while bending over.

Meanwhile, a downward ice pickup mechanism using a dispenser can be provided to the freezer room. In such a case, a location of the ice bank is too low. Hence, it is difficult to employ a system of discharging ice to a lower position via the downward pickup mechanism.

Namely, in case of adopting the related art downward ice pickup system while the ice machine is left in the freezer room at the lower part of the refrigerator body, a user needs to further bend over. Hence, more inconvenience is caused to the user instead of removing the inconvenience in use.

Therefore, it is difficult to adopt the related art downward ice pickup system in the structure having the ice machine provided to the freezer room in the lower part of the refrigerator body. A new ice pickup structure is needed to remove the bending-over inconvenience.

In case of providing the ice machine to the cold-storage room in the upper part of the refrigerator body to remove the inconvenience in use, a separate insulation space for ice-making needs to be provided within the cold-storage room. Hence, an inner space of the cold-storage room becomes limited in space. In addition to the configuration, in case of installing the dispenser for picking up the ice at the freezer room, the aforesaid inconvenience still remains and the freezer room becomes excessively narrow.

DISCLOSURE OF THE INVENTION

Accordingly, the present invention is directed to a refrigerator that substantially obviates one or more of the problems due to limitations and disadvantages of the related art.

An object of the present invention is to provide a refrigerator, in which cold-storage and freezer rooms are situated at upper and lower parts, respectively, in which ice made at the freezer room of the lower part is dispensed at the cold-storage room of the upper part, and by which a user can pick up the ice without bending over to enhance user's convenience.

Another object of the present invention is to provide a refrigerator, by which a separate insulation space is not needed within a cold-storage room to provide an ice machine to the cold-storage room unnecessarily and by which a space of a freezer room can be sufficiently secured without providing a dispenser installation space within the freezer room.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a refrigerator according to the present invention includes a body having a cold-storage room provided to an upper part and a freezer room provided to a lower part, an ice maker provided to the freezer room to make ice, an ice bank receiving the ice made by the ice maker, and a transport mechanism sending the ice discharged from the ice bank toward the cold-storage room via an ice transport passage.

To further achieve these and other advantages and in accordance with the purpose of the present invention, a refrigerator includes a body having a cold-storage room provided to an upper part and a freezer room provided to a lower part, an ice maker provided to the freezer room to make ice, an ice bank receiving the ice made by the ice maker, a conveyer mechanism sending the ice discharged from the ice bank to a transport position, a transport mechanism sending the ice sent to the transport position by the conveyer mechanism to a cold-storage room side via an ice transport passage, and a dispenser provided to the cold-storage room side to discharge the ice sent to the cold-storage room side by the transport mechanism via the ice transport passage to an outside of the cold-storage room side door.

To further achieve these and other advantages and in accordance with the purpose of the present invention, a refrigerator includes an ice maker provided to a freezer room situated at a lower part of a body to make to discharge ice downward, an ice bank provided under the ice maker, the ice bank having an open topside to receive the ice made by the ice maker and an ice discharge opening provided to a bottom side of the ice bank wherein the ice discharge opening can be opened/closed, a conveyer mechanism sending the ice discharged from the ice bank to a transport position, a freezer room side ice transport passage provided to one side of the ice bank, a chute box coupled to an inside of a cold-storage room side door, the chute box having an ice transport passage communicating with the freezer room side ice transport passage, and a transport mechanism discharging the ice conveyed to the transport position by the conveyer mechanism to a dispenser of the cold-storage room side door via the ice transport passage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
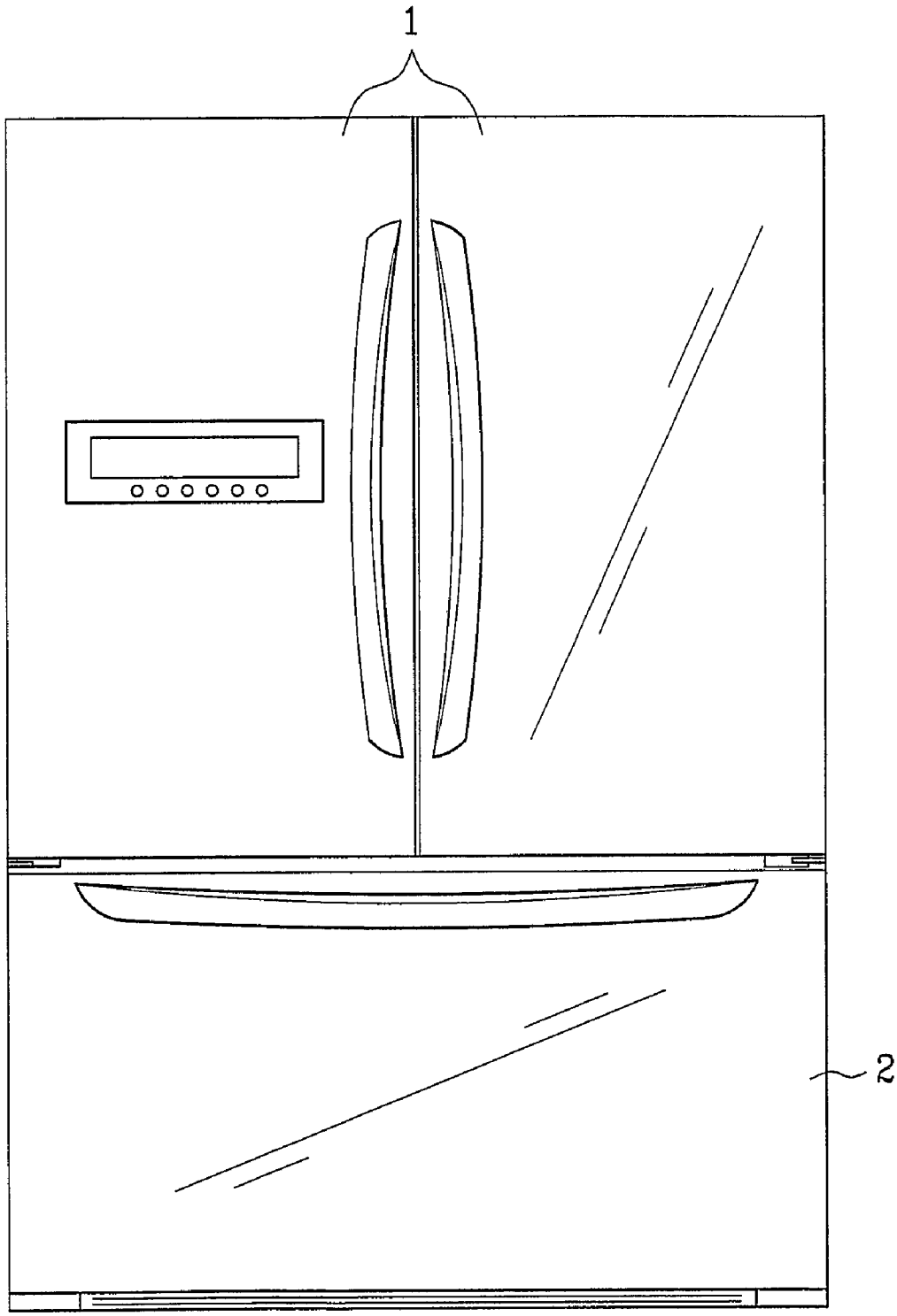
FIG. 1 is a front diagram of an exterior of a refrigerator according to a related art.
Figure 2:
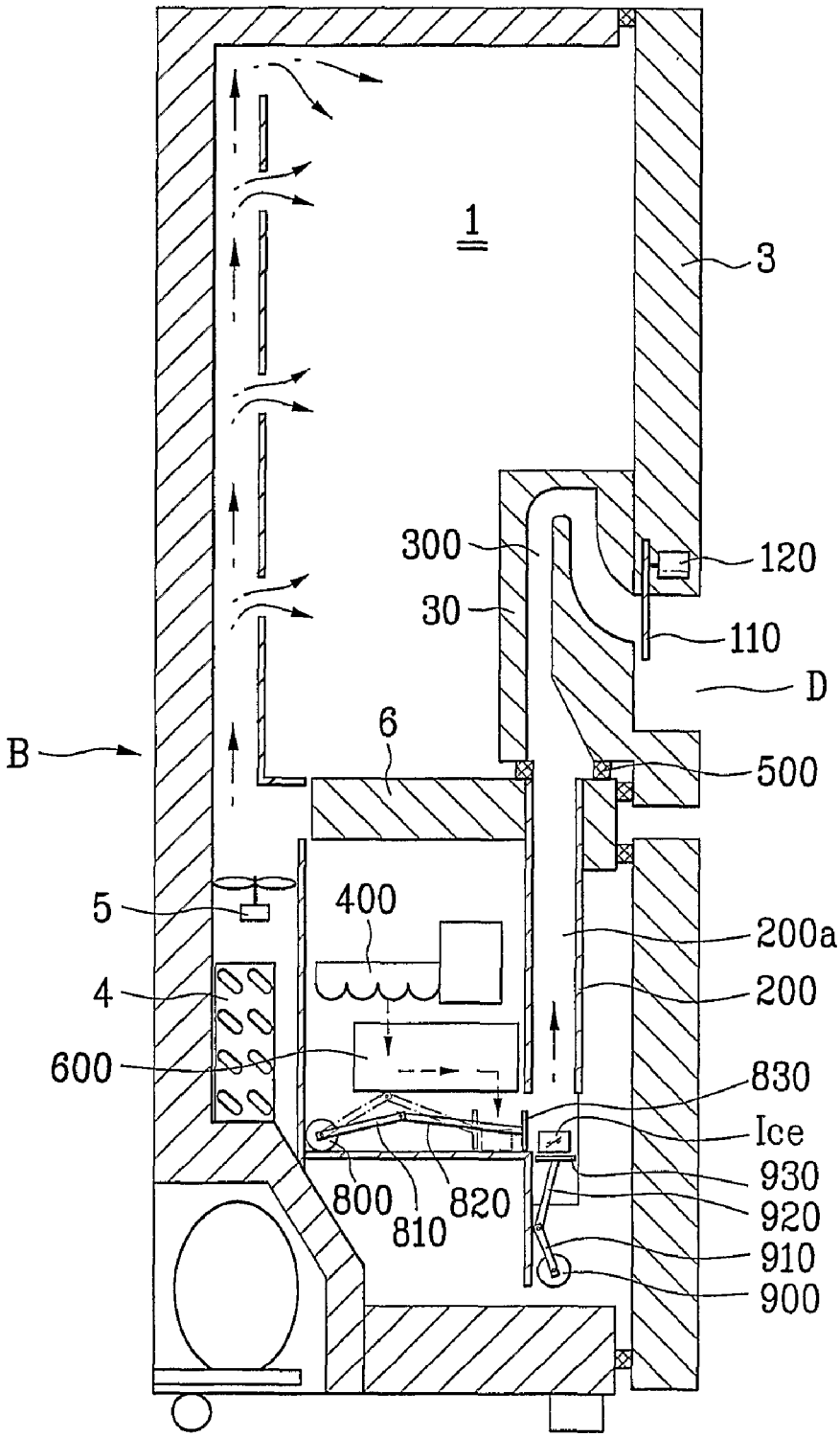
FIG. 2 is a cross-sectional diagram of a refrigerator provided with an ice pickup apparatus according to the present invention.
Figure 3:
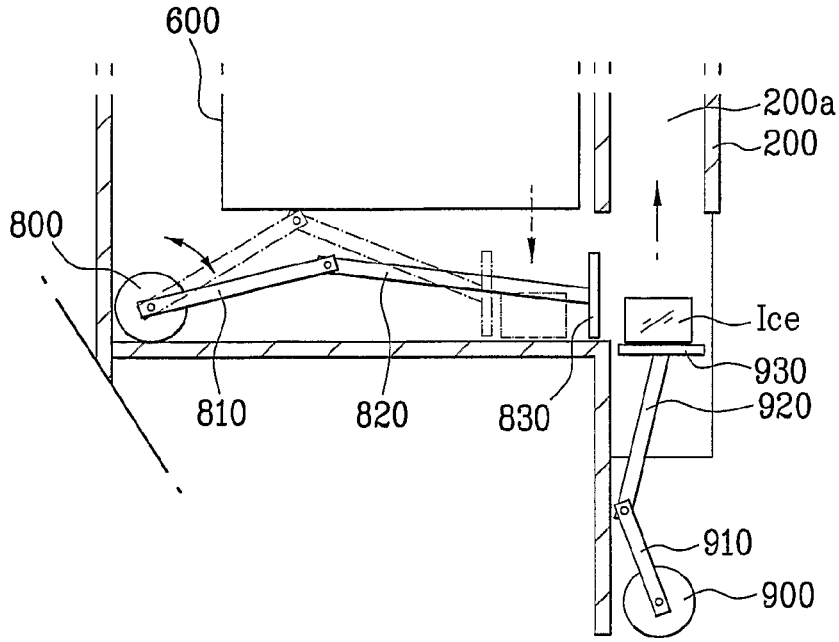
FIG. 3 is a magnified cross-sectional diagram for explaining an ice pickup process of the ice pickup apparatus in FIG. 2.

FIG. 2 is a cross-sectional diagram of a refrigerator provided with an ice pickup apparatus according to the present invention, and FIG. 3 is a magnified cross-sectional diagram for explaining an ice pickup process of the ice pickup apparatus in FIG. 2.

Referring to FIG. 2 and FIG. 3, a refrigerator according to the present invention includes an ice maker 400 provided to a freezer room 2 situated at a lower part of a body B to make to discharge ice downward, an ice bank 600 provided under the ice maker 400, the ice bank 600 having an open topside to receive the ice made by the ice maker 400 and an ice discharge opening provided to a bottom side of the ice bank 600 wherein the ice discharge opening can be opened/closed, a freezer room side ice transport passage 200*a* provided to one side of the ice bank 600, a chute box 30 coupled to an inside of a door 3 of a cold-storage room 1, the chute box 30 having an ice transport passage 300 communicating the freezer room side ice transport passage 200*a*, and a transport mechanism shooting up the ice discharged from the ice bank 600 via the ice transport passage 300 to discharge the ice to a dispenser D of the door 3 of the cold-storage room 1.

The transport mechanism includes a motor 900, a first link 910 connected to a shaft of the motor 900 to be rotated clockwise or counterclockwise by a drive force of the motor 900, and a second link 920 coupled to a front end of the first link 910 via hinge.

In this case, the motor 900 is a step motor enabling a rotational speed adjustment for a predetermined acceleration of the motor 900. This is because the ice can shot upward by the rotation at the predetermined acceleration.

Preferably, a push stick 930 having an area larger than that of the link is provided to a front end of the second link 920 to raise contact reliance with the ice.

More preferably, the push stick 930 is formed of a material having a prescribed cushion to avoid an impact on the ice.

Meanwhile, a conveyer mechanism is installed in a direction vertical to an installation direction of the transport mechanism to send the ice falling from the ice bank 200 to a shooting position.

The conveyer mechanism may have the same configuration of the transport mechanism.

Namely, the conveyer mechanism includes a motor 800, a first link 810 connected to a shaft of the motor 800 to be rotated clockwise or counterclockwise by a drive force of the motor 800, and a second link 820 coupled to a front end of the first link 810 via hinge. Preferably, a push stick 830 having an area larger than that of the link is provided to a front end of the second link 820.

The ice transport passage 300 of the chute box 30 approximately has a '∩' shape and a direction switching portion of an upper end of the chute box 30 is rounded. This is to prevent the ice shot upward by the transport mechanism from being broken and to enable the ice to slide down to be discharged to the dispenser D.

A sealing member 500 such as a gasket and the like is inserted between the chute box 30 and a barrier 6 to prevent the chill leakage.

An upper inside of the dispenser D of the door 3 of the cold-storage room 1 is provided with a shield plate 110, which cuts off thermal contact with an external air while the ice is not discharged, and a drive motor 120 for selectively opening/closing the ice discharge opening by rotationally moving the shield plate 110 centering on a hinge point in a right-and-left direction.

Optionally, the shield plate 110 can be installed to move in a back-and-forth or up-and-down direction.

The ice maker 400 is provided to the freezer-room 2 in the lower part of the refrigerator body B and the ice bank 600 is installed under the ice maker 400. Various kinds of general ice makers and banks are applicable to the ice maker and back 400 and 600, respectively, of which explanations are skipped in the following.

A topside of the ice bank 600 has an open box shape to receive the ice made by the ice maker 400. The ice bank 600 has a size suitable for a refrigerator capacity and ice storage capacity. Alternatively, a shape of the ice bank 600 can be variously modified according to a shape of an ice landing portion.

An ice transporter (not shown in the drawing) is provided to an upper within the ice bank 600. The ice transporter is operative in dropping the ice stored in the ice bank 600 onto a horizontal passage underneath.

The ice transporter (not shown in the drawing) may include a helical auger and a motor rotating the auger.

Numeral references '4', '5', and '200' indicate an evaporator, a blower fan, and a wall body configuring the ice transport passage.

An operation of the above-configured present invention is explained as follows.

First of all, a process of making ice by the ice maker 400 and discharging the ice to the ice bank 600 is repeated to store a prescribed quantity of the ice in the ice bank 600.

While the prescribed quantity of the ice is stored in the ice bank 600, an ice dispensing button of a control panel is pressed. If so, the ice comes out of the ice bank 600 by an action of the ice transporter (not shown in the drawing).

Namely, the ice discharged from the ice bank 600 falls down to the horizontal passage under the ice bank 600, whereby the first and second links 810 and 820, as shown in FIG. 3, spread from one state indicated by a doted line to the other state indicated by a solid line to send the ice to the freeze-room side ice transport passage 200*a*.

In doing so, the conveyer mechanism pushes the ice to be set by a shooting timing of the transport mechanism.

Meanwhile, the ice sent to the freeze-room side ice transport passage 200*a* is situated on the push stick 930 to be shot upward by the shooting action of the transport mechanism.

Namely, the motor 900 configuring the transport mechanism is rotated at a predetermined acceleration to bounce up.

Specifically, the motor 900 is the step motor and is controlled in a manner of gradually rotating faster in shooting the ice upward and gradually slowing down its rotational speed.

The ice shot on the freezer-room side ice transport passage 200*a* passes through the passage provided to the barrier 6, moves along the ice transport passage 300 of the chute box 30 provided to the door 3 of the cold-storage room 1, and is then discharged to the dispenser D.

In doing so, since the direction switching portion at the upper end of the chute box 30 is rounded to have the '∩' shape, the ice, which avoids being broken in the process of switching its moving direction, slides down to be discharged to the dispenser D.

In the above-explained process, the shield plate 110 provided to an upper side of the dispenser D may be opened each time the ice individually slides down along the ice transport passage 300. Preferably, the shield plate 110 is opened when a prescribed quantity of ice gathers in the ice transport passage 300 to be collectively picked up.

Meanwhile, the dispenser D is preferably situated at a height of a user's waist or chest. This is to enable a user not to bend over in picking up the ice from the dispenser D.

It is apparent that an installation height of the dispenser D can be determined by considering an averaged height of nation or housewives.

Figure 4:
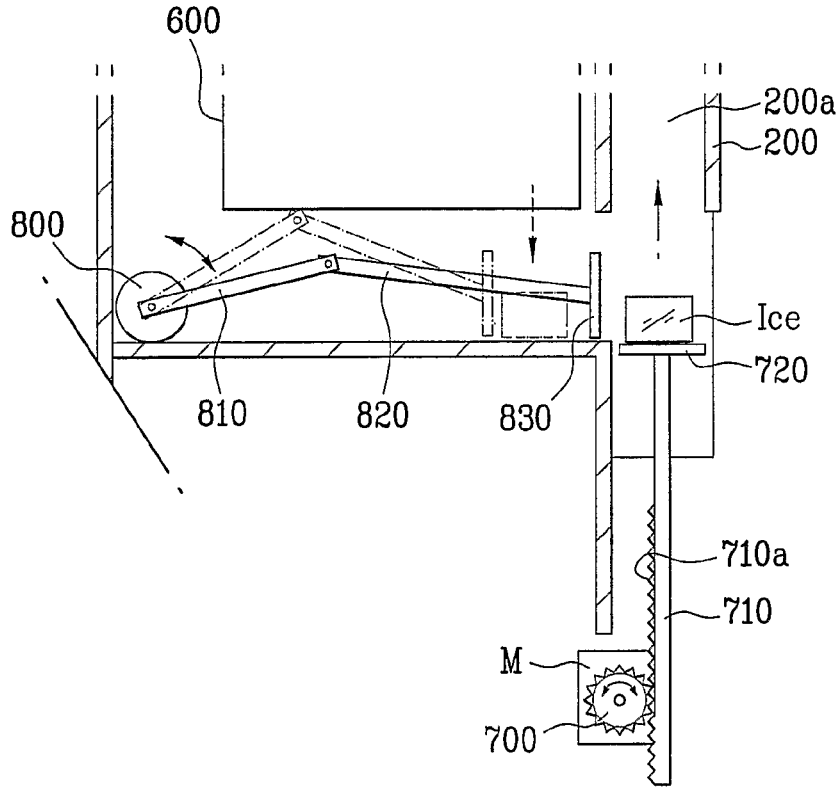
FIG. 4 is a magnified cross-sectional diagram of an ice pickup apparatus according to another embodiment of the present invention.

FIG. 4 is a magnified cross-sectional diagram of an ice pickup apparatus according to another embodiment of the present invention.

Referring to FIG. 4, an ice transport mechanism includes a motor M rotatable at predetermined acceleration, a pinion 700 shaft-coupled to the motor M to have gear teeth, and a rack 710 provided with another gear teeth 710*a* engaging with the gear teeth of the pinion 700.

Preferably, a push stick 720 is provided to a front end of the rack 710 to increase a contact area with ice that is shot upward.

Alternatively, the transport mechanism can be configured in a following manner.

First of all, a link mechanism is configured with a rapid return mechanism having a mean speed difference between a forward stroke and a return stroke instead of a motor having a predetermined rotational speed. The rapid return mechanism instantly transfers a force on a rapid return motion to shoot up the ice.

INDUSTRIAL APPLICABILITY

Accordingly, the refrigerator according to the present invention provides the ice machine to the freezer room under the cold-storage room so that the ice is dispensed to the cold-storage room side, thereby expanding the space of the cold-storage room without providing the separate insulation space to the cold-storage room.

In case that the ice machine is provided to the freezer-room situated under the freezer room, a user can pick up the ice from the dispenser without bending over.

Moreover, the resent invention needs not to provide the separate insulation space within the cold-storage room to provide the ice machine to the cold-storage room, thereby securing the sufficient space of the cold-storage room.

Besides, the present invention does not provide the dispenser to the freezer room side, thereby securing the sufficient space of the freezer room.

Therefore, the present invention sufficiently secures the spaces of the cold-storage and freezer rooms to raise spatial efficiency and to facilitate the ice pick-up, thereby enhancing user's product reliance.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A refrigerator, comprising:

a body having a cold-storage compartment provided at an upper part thereof and a freezer compartment provided at a lower part thereof;

an ice maker provided at the freezer compartment;

an ice bank that receives ice made by the ice maker; and a transport mechanism that transports ice discharged from the ice bank toward the cold-storage compartment via an ice transport passage, the transport mechanism comprising:

a transport motor; and a plurality of transport links coupled to a shaft of the motor such that the plurality of transport links rotate in response to a driving force generated by the transport motor, wherein a distal end of one of the plurality of transport links is configured to contact the ice discharged from the ice bank and direct the ice toward the cold-storage compartment as the plurality of transport links rotate.

2. The refrigerator of claim 1, wherein the ice bank is provided under the ice maker, the ice bank having an open topside so as to receive the ice made by the ice maker and an ice discharge opening provided at a bottom side of the ice bank, wherein the ice discharge opening is configured to be opened/closed.

3. The refrigerator of claim 1, wherein the ice transport passage comprises a freezer side ice transport passage and a cold-storage side ice transport passage.

4. The refrigerator of claim 3, wherein an end of the cold-storage side ice transport passage is connected to a chute box provided at an inside of a door of the cold-storage compartment.

5. The refrigerator of claim 4, wherein the cold storage side ice transport passage is provided in the chute box approximately has an inverted U shape such that a portion thereof at which a transport direction of the ice is changed is rounded.

6. The refrigerator of claim 4, further comprising a sealing member inserted between the chute box and a barrier partitioning the cold-storage compartment and the freezer compartment.

7. The refrigerator of claim 3, further comprising a dispenser provided in a door of the cold-storage compartment to discharge ice sent to the cold-storage compartment by the transport mechanism via the ice transport passage.

8. The refrigerator of claim 7, further comprising a shield plate provided on the dispenser to cut off thermal contact with external air while ice is discharged from the dispenser.

9. The refrigerator of claim 8, further comprising a drive motor that selectively rotates the shield plate relative to an ice discharge opening of the dispenser so as to selectively open/close the ice discharge opening.

10. The refrigerator of claim 8, further comprising a drive motor that selectively moves the shield plate in a back-and-forth or up-and-down direction so as to selectively open/close an ice discharge opening of the dispenser.

11. The refrigerator of claim 1, wherein the transport motor is a step motor enabling a rotational speed adjustment for a predetermined acceleration of the transport motor.

12. The refrigerator of claim 1, wherein the transport mechanism further comprises a push stick provided at the distal end of the one of the plurality of transport links and is configured to contact the ice, wherein an area of the push stick is greater than an area of the distal end of the one of the plurality of transport links so as to increase a contact area with the ice.

13. The refrigerator of claim 1, further comprising a conveyer mechanism that directs ice discharged from the ice bank to a transport position for transport by the transport mechanism.

14. The refrigerator of claim 13, the conveyer mechanism comprising:

a conveyor motor; and a conveyor link connected to a shaft of the conveyor motor so as to be rotated clockwise or counterclockwise in response to a drive force of the conveyor motor.

15. The refrigerator of claim 1, wherein the transport motor has a predetermined rotational speed and a rapid return mechanism having a mean speed difference between a forward stroke and a return stroke.

16. A refrigerator, comprising:

a body having a cold-storage room provided at an upper part thereof and a freezer room provided at a lower part thereof;

an ice maker provided in the freezer room;

an ice bank that receives ice made by the ice maker; and a transport mechanism that directs ice discharged from the ice bank toward the cold-storage room via an ice transport passage, the transport mechanism comprising:

a transport motor rotatable at a predetermined acceleration;

a pinion coupled to the transport motor, the pinion including a first plurality of gear teeth; and a rack coupled to the pinion, the rack including a second plurality of gear teeth configured to engage with the first plurality of gear teeth of the pinion.

17. The refrigerator of claim 16, the transport mechanism further comprising a push stick provided at a front end of the rack so as to increase a contact area with the ice.

18. The refrigerator of claim 17, wherein the push stick is formed of a material having a prescribed cushion to avoid an impact on the ice.

* * * * *